US009835406B2

(12) United States Patent
Maeda

(10) Patent No.: US 9,835,406 B2
(45) Date of Patent: Dec. 5, 2017

(54) TOY GUN

(71) Applicant: MARUZEN COMPANY LIMITED, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 15/374,245

(22) Filed: Dec. 9, 2016

(65) Prior Publication Data

US 2017/0167824 A1 Jun. 15, 2017

(30) Foreign Application Priority Data

Dec. 10, 2015 (JP) ..... 2015-241234

(51) Int. Cl.
*F41B 11/89* (2013.01)
*F41B 11/642* (2013.01)

(52) U.S. Cl.
CPC ..... *F41B 11/89* (2013.01); *F41B 11/642* (2013.01)

(58) Field of Classification Search
CPC ..... F41A 3/12; F41A 3/14; F41A 3/36; F41A 3/38; F41A 3/44; F41A 3/48; F41A 3/74; F41A 3/76; F41A 9/32; F41A 9/34; F41A 9/40; F41A 9/46; F41A 9/47; F41A 19/06; F41A 19/10; F41A 19/09; F41A 19/25; F41A 19/26; F41A 19/27; F41A 19/28
See application file for complete search history.

(56) References Cited

U.S. PATENT DOCUMENTS 220,785 A * 10/1879 Barthel ..... F41A 19/10 42/69.01
2,716,923 A * 9/1955 Gaidos ..... F41A 3/44 42/69.02
2,865,126 A * 12/1958 Dardick ..... F41A 9/27 102/436
3,109,345 A * 11/1963 Norman ..... F41A 3/44 42/16

(Continued)

FOREIGN PATENT DOCUMENTS

DE 20 200 6018601 U1 2/2007
EP 1394493 A1 3/2004

(Continued)

OTHER PUBLICATIONS

Extended Search Report issued in European Application No. 16002567.2, dated Feb. 23, 2017.

(Continued)

*Primary Examiner* — Derrick Morgan
(74) *Attorney, Agent, or Firm* — Michael Best & Friedrich LLP

(57) ABSTRACT

A toy gun includes: a nail arm which is rotated around a nail arm rotating shaft placed in a position opposite to the cartridge with a trigger rotating shaft in between and is substantially in an L shape; a guide as a long hole which is provided in the nail arm and guides a terminal; a nail which is attached to a tip of the nail arm and can be engaged with a cartridge loading portion; and a link which is attached to a cover capable of being abutted against a cartridge loading portion and slides the cover to the cartridge side or the side opposite to the cartridge by bringing the terminal into or out of abutment.

4 Claims, 18 Drawing Sheets

(56) References Cited

U.S. PATENT DOCUMENTS

| | | | | |
|---|---|---|---|---|
| 4,428,138 | A | 1/1984 | Seecamp | |
| 4,449,313 | A * | 5/1984 | Hackett | F41A 9/62 42/69.01 |
| 4,514,923 | A * | 5/1985 | Teel | F41A 19/09 42/69.01 |
| 4,577,430 | A * | 3/1986 | Ruger | F41A 19/10 42/69.01 |
| 5,092,068 | A * | 3/1992 | Rick | F41C 3/16 42/64 |
| 5,160,795 | A | 11/1992 | Milliman | |
| 6,571,499 | B1 * | 6/2003 | Dikov | F41A 9/25 42/11 |
| 7,669,588 | B2 * | 3/2010 | Maeda | F41B 11/54 124/74 |
| 8,505,225 | B1 * | 8/2013 | Degener | F41A 19/10 42/69.01 |
| 9,250,033 | B1 * | 2/2016 | Wei | F41A 9/73 |
| 9,671,186 | B1 * | 6/2017 | Hoekema | F41A 19/17 |
| 2009/0056692 | A1 * | 3/2009 | Maeda | F41B 11/54 124/63 |
| 2013/0174460 | A1 * | 7/2013 | Aigner | F41A 19/12 42/69.01 |
| 2013/0263840 | A1 * | 10/2013 | Maeda | F41B 11/721 124/76 |
| 2015/0168091 | A1 * | 6/2015 | Doll | F41A 17/46 42/69.01 |
| 2015/0308784 | A1 * | 10/2015 | Cho | F41A 19/10 124/31 |
| 2015/0338181 | A1 * | 11/2015 | McAlister | F41A 19/10 42/6 |
| 2016/0187095 | A1 * | 6/2016 | Liao | F41A 33/00 434/16 |
| 2016/0258712 | A1 * | 9/2016 | Maeda | F41B 11/89 |
| 2017/0153082 | A1 * | 6/2017 | Maeda | F41B 11/723 |

FOREIGN PATENT DOCUMENTS

| | | |
|---|---|---|
| TW | I325048 B | 5/2010 |
| TW | I331208 B | 10/2010 |
| TW | I431239 B | 3/2014 |

OTHER PUBLICATIONS

Search Report issued in Taiwan Application No. 105140109, dated May 18, 2017.

* cited by examiner

TOY GUN

CROSS-REFERENCE TO RELATED APPLICATION(S)

This application is based upon and claims the benefit of priority from Japanese Patent Application JP2015-241234 filed on Dec. 10, 2015, the entire disclosure of which are incorporated herein by reference.

BACKGROUND OF THE INVENTION

Field of the Invention

The present invention relates to toy guns and in particular to a rotating mechanism of a cartridge for toy guns. The present invention relates in more particular to a rotating mechanism of a cartridge for toy guns which rotates the cartridge in conjunction of firing of a bullet, in a toy gun provided with the cartridge loaded with bullets such as BB bullets.

Description of Related Art

As a toy gun charging mechanism which feeds bullets such as BB bullets into a conventional toy gun, for example, one patented to the present applicant and shown in the drawings in Patent Document 1 is known (see U.S. Pat. No. 7,669,588).

SUMMARY OF THE INVENTION

It is an object of the present invention to increase the operating range of a cartridge actuated each time a trigger is once pulled.

The toy gun of the present invention includes:

an inner barrel through which a bullet passes when the bullet is fired;

a cartridge placed at the base of the inner barrel and continuously provided with cartridge loading portions loaded with bullets;

a trigger placed below the inner barrel and operated to fire a bullet;

a trigger rotating shaft providing the rotating shaft of the trigger;

a terminal provided closer to the inner barrel than to the trigger rotating shaft on the extension line of the trigger;

a nail arm rotating shaft placed on the side opposite to the cartridge with the trigger rotating shaft in between;

a nail arm rotated around the nail arm rotating shaft;

a guide as a long hole provided in the nail arm in a direction along the inner barrel as a whole and guiding the terminal;

a nail which is attached to a tip of the nail arm and can be engaged with a cartridge loading portion;

a cover which is provided at the end of the inner barrel on the cartridge side, can be abutted against the cartridge loading portion, and can be slid to the cartridge side and the side opposite to the cartridge; and a link which slides the cover to the cartridge side and the side opposite to the cartridge by bringing the terminal into and out of abutment.

The link may be attached to the cover. The toy gun may include a nail arm which is substantially in an L shape.

DETAILED DESCRIPTION OF THE PREFERRED EMBODIMENTS

A description will be given to an example of an embodiment of the present invention with reference to the drawings illustrating an example of the present invention.

Figure 1:
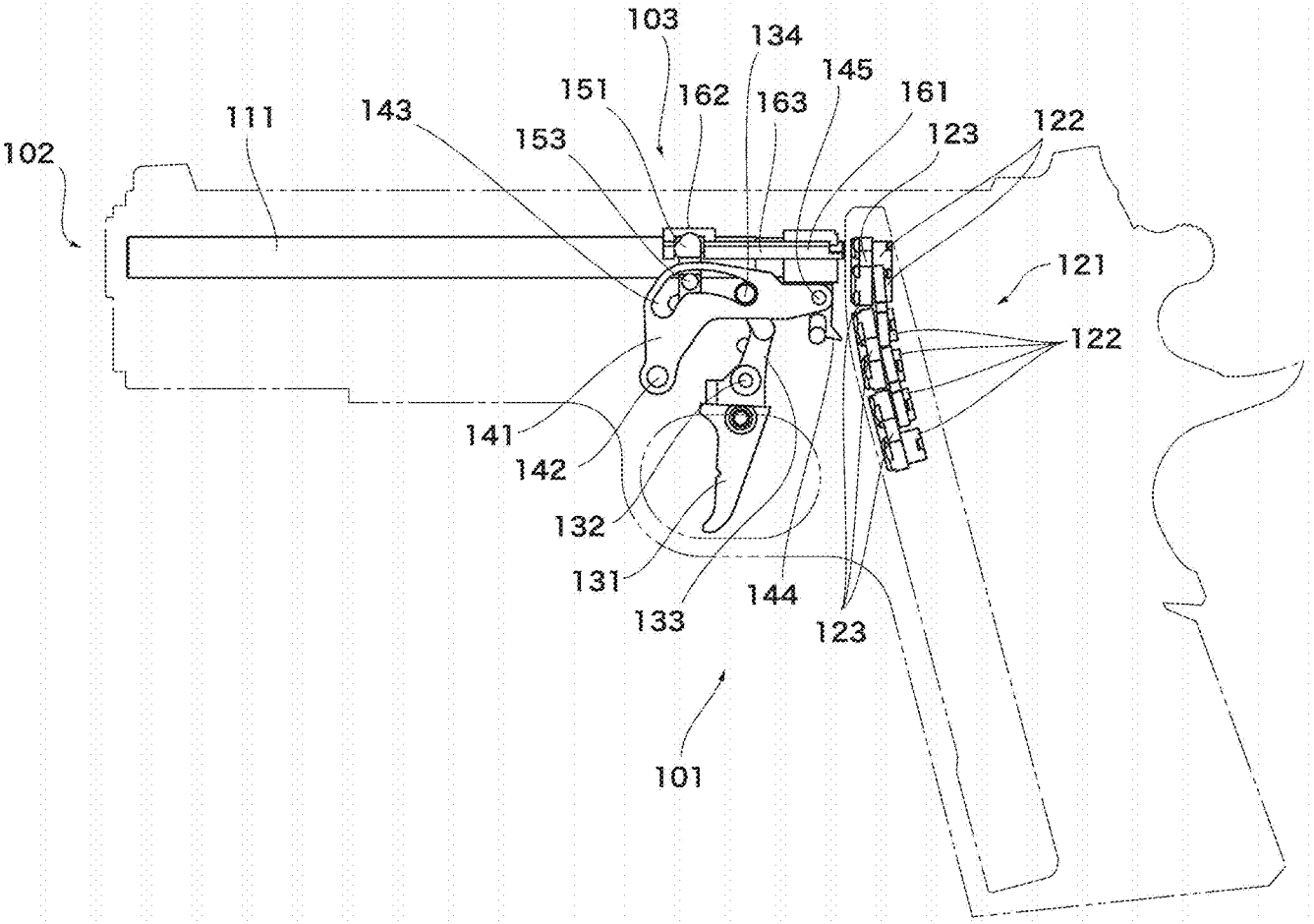
FIG. 1 is a front sectional view of a toy gun in an example of an embodiment of the present invention as is in an initial state.

In FIG. 1 and the following drawings, reference numeral 101 denotes a toy gun main body and 102 denotes a muzzle. Reference numeral 111 denotes an inner barrel. The inner barrel 111 is placed in a barrel 103 in the upper part of the toy gun main body 101 such that the inner barrel 111 is extended from the muzzle 102 toward the rear part along the barrel 103. When a bullet is fired, the bullet passes through the inner barrel 111.

Reference numeral 121 denotes a cartridge. The cartridge 121 is placed at the base of the inner barrel 111 and is continuously provided with cartridge loading portions loaded with bullets. The cartridge 121 is housed in a cartridge case or a magazine body and is inserted into the toy gun main body 101 on the rear side of the trigger 131, or the right side of the drawing, that is, on the side opposite to the muzzle 102.

The cartridge 121 is inserted ahead of or behind the trigger 1 depending on the type of the toy gun. In this example, the cartridge 121 is provided behind the trigger 131.

Figure 19:
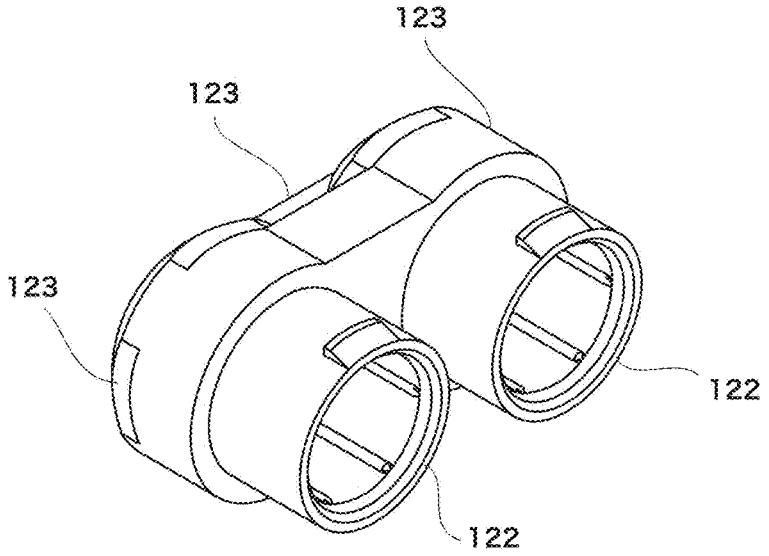
FIG. 19 is a top perspective view of loading portions in a toy gun in an example of an embodiment of the present invention.
Figure 20:
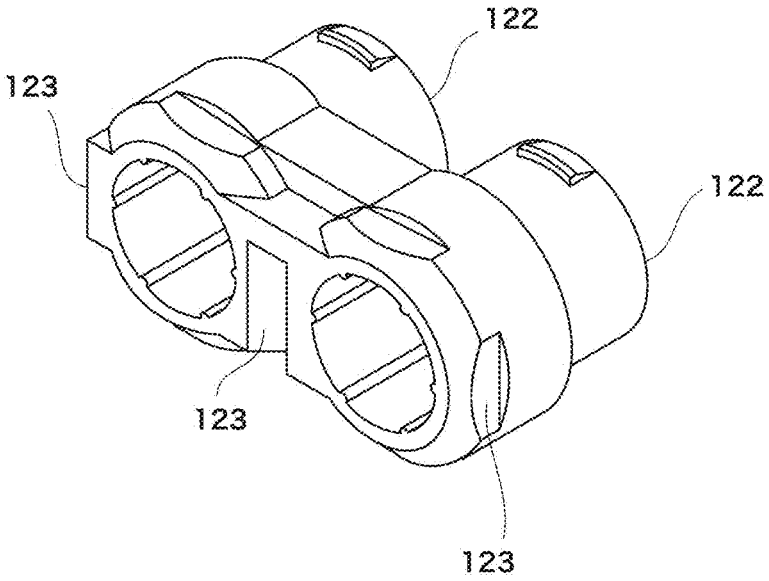
FIG. 20 is a bottom perspective view of loading portions in a toy gun in an example of an embodiment of the present invention.

As illustrated in FIG. 19 and FIG. 20, the cartridge 121 is formed by continuously coupling multiple sets of two cylindrical loading portions 122 of the same shape; the cartridge 121 is of an endless type in which the first and last sets are coupled together or of a continuous type in which the first and last sets are not coupled together. The loading portions 122 are loaded therein with bullets.

With the cartridge case or the magazine body housing the cartridge 121 loaded into the toy gun main body 101, the cartridge 121 is in the shape of a ring or in a continuous shape as viewed from the muzzle 102 side. In the case of a ring shape, the cartridge 121 is endless; in the case of a continuous shape, the first and last sets of loading portions are not coupled together. Each loading portion 122 is provided on the lateral side with a recessed fitting portion 123. In case of sets of two loading portions 122, the area between sets of two loading portions 122 provides a fitting portion 123.

Reference numeral 131 denotes a trigger and 132 denotes a trigger rotating shaft. The trigger 131 is placed below the inner barrel 111 attached to the toy gun main body 101 and gas such as air is jetted to fire a bullet by operating the trigger 131.

The trigger 131 is energized clockwise in the drawing by a trigger spring (not shown). The trigger 131 can be rotated counterclockwise in the drawing around the trigger rotating shaft 132.

Figure 2:
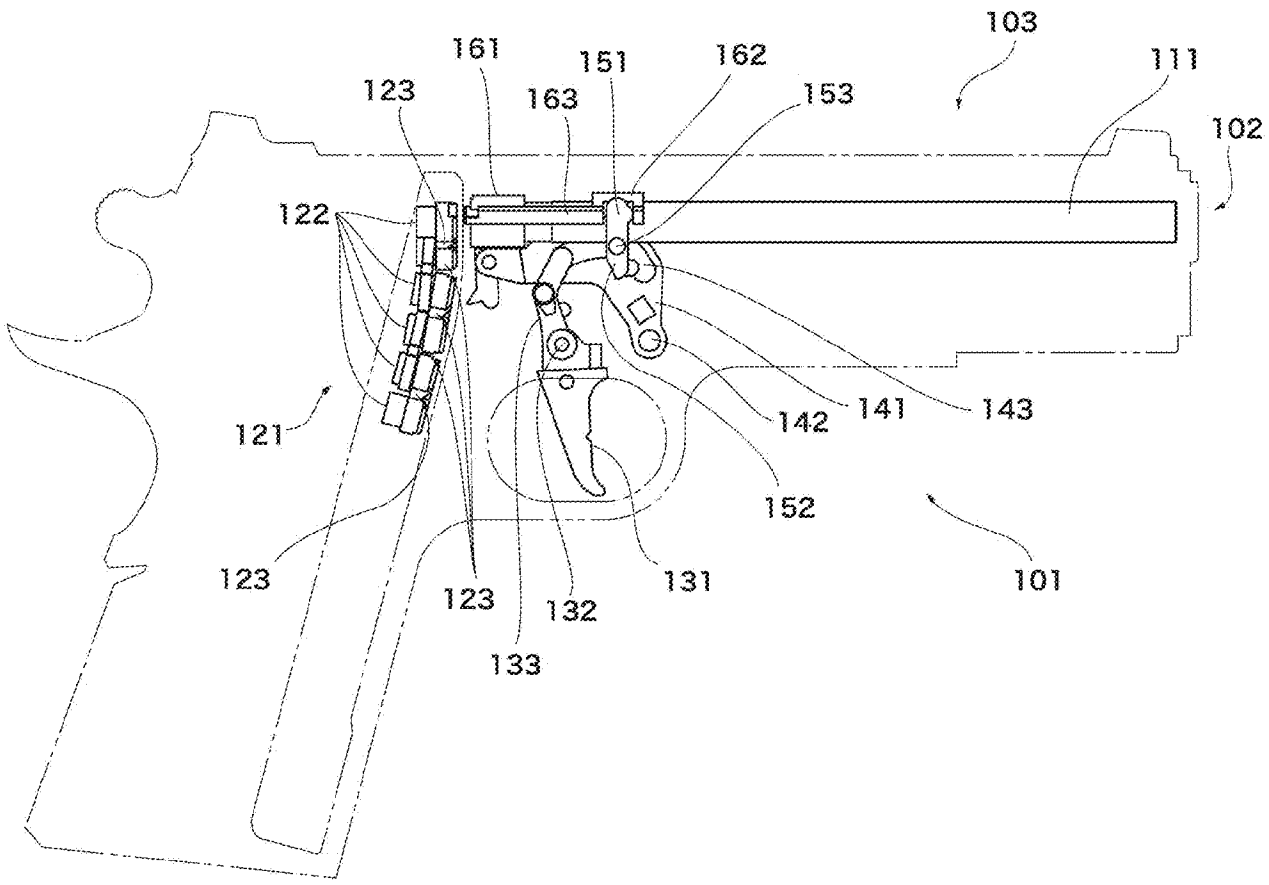
FIG. 2 is a rear sectional view of a toy gun in an example of an embodiment of the present invention as is in an initial state.

A projection 133 is protruded from the trigger 131 to above the trigger rotating shaft 132. A terminal 134 is provided at a tip of the projection 133 closer to the inner barrel 111 than to the trigger rotating shaft 132 on the extension line of the trigger 131. As illustrated in FIG. 1 and FIG. 2, the terminal 134 is perpendicularly protruded from the projection 133 toward the near side of FIG. 1.

Reference numeral 141 denotes a nail arm and 142 denotes a nail arm rotating shaft. The nail arm rotating shaft 142 is placed at the same distance from the inner barrel 111 as the trigger rotating shaft 132 is.

The nail arm rotating shaft 142 is provided at the end of the nail arm 141 on the muzzle 102 side. The nail arm 141 is rotated around the nail arm rotating shaft 142. The nail arm rotating shaft 142 is placed on the side opposite to the cartridge 121 with the trigger rotating shaft 132 in between.

Reference numeral 144 denotes a nail. A tip of the nail 144 is protruded and the nail 144 is fixed to the nail arm 141 by a nail mounting shaft 145 at the base of the nail 144.

As illustrated in drawings, the nail arm 141 is formed of an L-shaped plate-like body as a whole.

In this example, as illustrated in FIG. 19 and FIG. 20, the cartridge 121 is formed by continuously coupling multiple cylindrical loading portions 122 of the same shape. The first and last sets of loading portions 122 are coupled together and thus the cartridge 121 constitutes a ring without an end.

For this reason, some force is required to actuate the cartridge 121. The inventors found that the cartridge could be moved by smaller force by moving the nail 144 downward rather than upward. For this reason, in this example, the nail 144 is configured to be moved downward.

Meanwhile, to increase the operating range of the nail 144, it is necessary to increase the distance between the trigger rotating shaft 132 and a portion moving the nail arm 141 as much as possible. In this example, the nail arm rotating shaft 142 is placed on the side opposite to the cartridge 121 with the trigger rotating shaft 132 in between. This makes it possible to lengthen the distance between the trigger rotating shaft 132 and the portion moving the nail arm 141 as much as possible.

In addition, because of the positional relation between the nail 144 and the terminal 134 which is the portion of the trigger 131 moving the nail arm 141, the nail arm rotating shaft 142 of the nail arm 141 is positioned on the muzzle 102 side of the trigger 131. The shape of the nail arm 141 could be further simplified by taking the following measure: the nail arm rotating shaft 142 of the nail arm 141 is placed in any position on the extension line of the nail mounting shaft 145 and the terminal 134 which is the portion of the trigger 131 moving the nail arm 141.

In this example, the nail arm rotating shaft 142 of the nail arm 141 is placed at the same distance from the inner barrel 111 as the trigger rotating shaft 132 shown in drawings and the nail arm is substantially triangular. However, the triangular nail arm 141 will interfere with the trigger rotating shaft 132 of the trigger 131 when the trigger 131 is pulled to lower the nail 144 to the lowest point. To avoid this, the interfering portion is recessed; as a result, the nail arm 141 is in a shape close to L shape as in this example.

Reference numeral 143 denotes a guide. The guide 143 is an L-shaped long hole convex at the center and is provided in the nail arm 141 in the direction along the inner barrel 111 as a whole.

The terminal 134 is fit into the guide 143, which guides the terminal 134 along the long hole.

Reference numeral 144 denotes a nail. The nail 144 has a shape having a protruded tip. The nail 144 is attached to the tip of the nail arm 141 on the cartridge 121 side and can be engaged with a fitting portion 123 of cartridge loading portions 122.

The nail 144 is abutted against the cartridge 121. While the cartridge 121 is fit through a fitting portion 123 of the cartridge 121, the nail arm 141 is rotated around the nail arm rotating shaft 142. As a result, the tip of the nail arm 141 is moved downward. In conjunction with this, the nail 144 is moved downward, moving the cartridge 121 downward.

Figure 17:
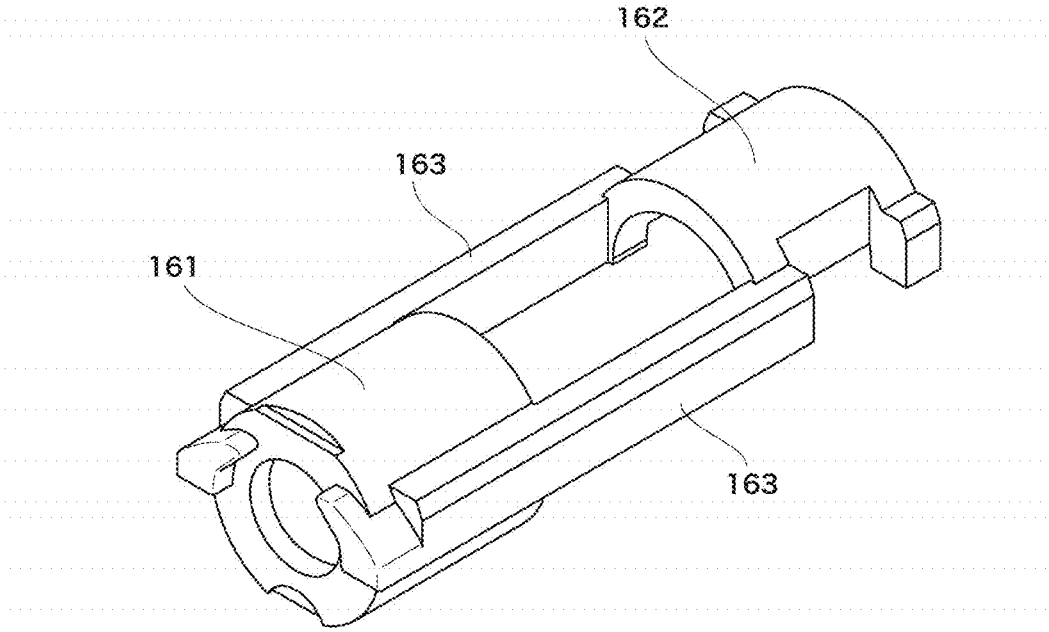
FIG. 17 is a top perspective view of a cover in a toy gun in an example of an embodiment of the present invention.
Figure 18:
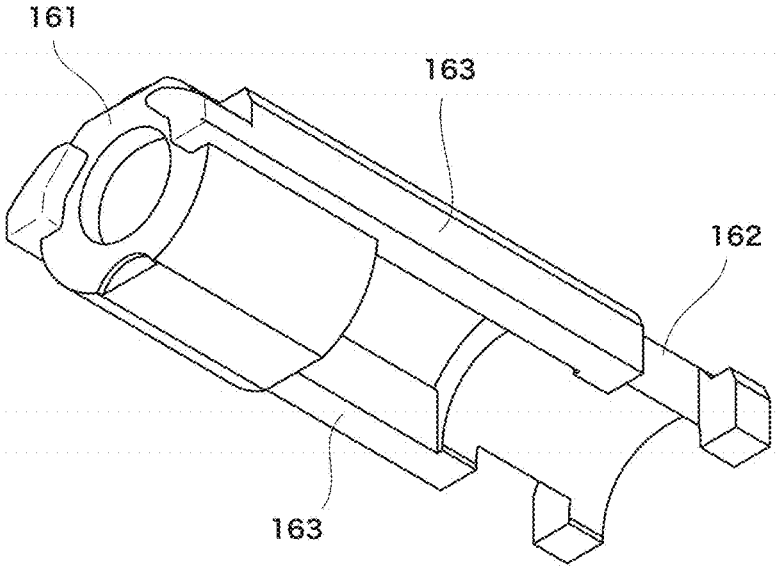
FIG. 18 is a bottom perspective view of a cover in a toy gun in an example of an embodiment of the present invention.

Reference numeral 161 denotes a cover. As illustrated in FIG. 17 and FIG. 18, the cover 161 is substantially cylindrical. The cover 161 is fit to the end of the inner barrel 111 on the cartridge 121 side and placed there. The end of the cover 161 on the cartridge loading portion 122 side can be abutted against cartridge loading portions 122. In addition, the cover 161 can be slid to the cartridge 121 side and to the side opposite to the cartridge 121.

Reference numeral 162 denotes a link fitting portion. As illustrated in FIG. 17 and FIG. 18, the link fitting portion 162 forms a recess inside thereof. Reference numeral 163 denotes a coupling portion, which couples the end of the cover 161 on the cartridge loading portion 122 side with both ends thereof on the muzzle 102 side.

Reference numeral 151 denotes a link. As illustrated in FIG. 1 and FIG. 2, the link 151 is formed of a rod-like member. The upper end of the link 151 is fit to the link fitting portion 162 of the cover 161 attached to the inner barrel 111.

The lower end of the link 151 is provided with a recessed terminal abutting portion 152 abutted against the terminal 134. Reference numeral 153 denotes a link rotating shaft and the link 151 is attached to the inner barrel 111 such that the link 151 can be rotated around the link rotating shaft 153 to the muzzle 102 side or to the side opposite to the muzzle 102. The terminal abutting portion 152 is placed on the trajectory of the terminal 134. For this reason, when the link 151 is brought into or out of abutment against the terminal abutting portion 152, the terminal 134 slides the cover 161 to the cartridge 121 side or the side opposite to the cartridge 121.

A description will be given to the action of the example with reference to the drawings.

As illustrated in the front view in FIG. 1 and the rear view in FIG. 2, in an initial state, each part is positioned as described below:

The trigger 131 has not been pulled yet. For this reason, the terminal 134 is positioned in a position in the guide 143 of the nail arm 141 closest to the cartridge 121.

Since the nail arm 141 has not been moved, the nail 144 is positioned away from the cartridge 121 and the tip of the nail 144 has not been in contact with the cartridge 121.

Since the link 151 has not been in contact with the terminal 134 yet, the link 151 faces downward in the direction perpendicular to the inner barrel 111.

Since the link 151 has not been moved, the end of the cover 161 on the cartridge 121 side is at a distance from loading portions 122.

As illustrated in the front view in FIG. 3 and the rear view in FIG. 4, at the moment at which the nail 144 starts moving loading portions, each part is positioned as described below:

The trigger 131 is slightly pulled. For this reason, the terminal 134 is moved to a position slightly close to the muzzle 102 in the guide 143 of the nail arm 141.

Since the nail arm 141 has been moved slightly closer to the cartridge 121, the tip of the nail 144 is brought close to the cartridge 121 and is fit into a fitting portion 123 of the cartridge 121.

Since the link 151 has not been in contact with the terminal 134 yet, the link 151 faces downward in the direction perpendicular to the inner barrel 111.

Since the link 151 has not been moved, the end of the cover 161 on the cartridge 121 side is at a distance from loading portions 122.

As illustrated in the front view in FIG. 5 and the rear view in FIG. 6, in the process of the nail 144 moving loading portions 122, each part is positioned as described below:

The trigger 131 has been further pulled. For this reason, the terminal 134 is moved to the substantially middle position in the guide 143 of the nail arm 141.

Figure 3:
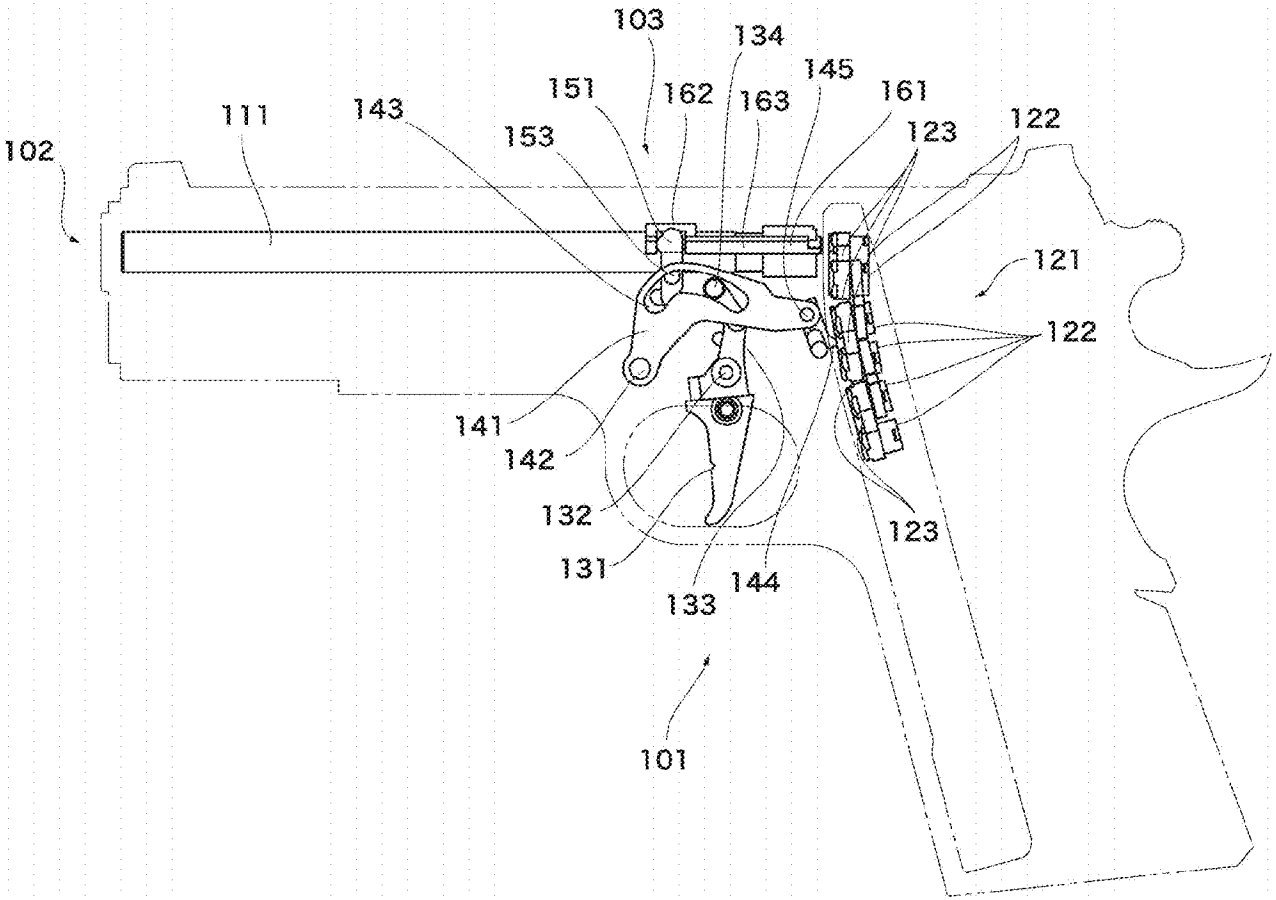
FIG. 3 is a front sectional view of a toy gun in an example of an embodiment of the present invention at the moment at which a nail starts moving a loading portion.
Figure 4:
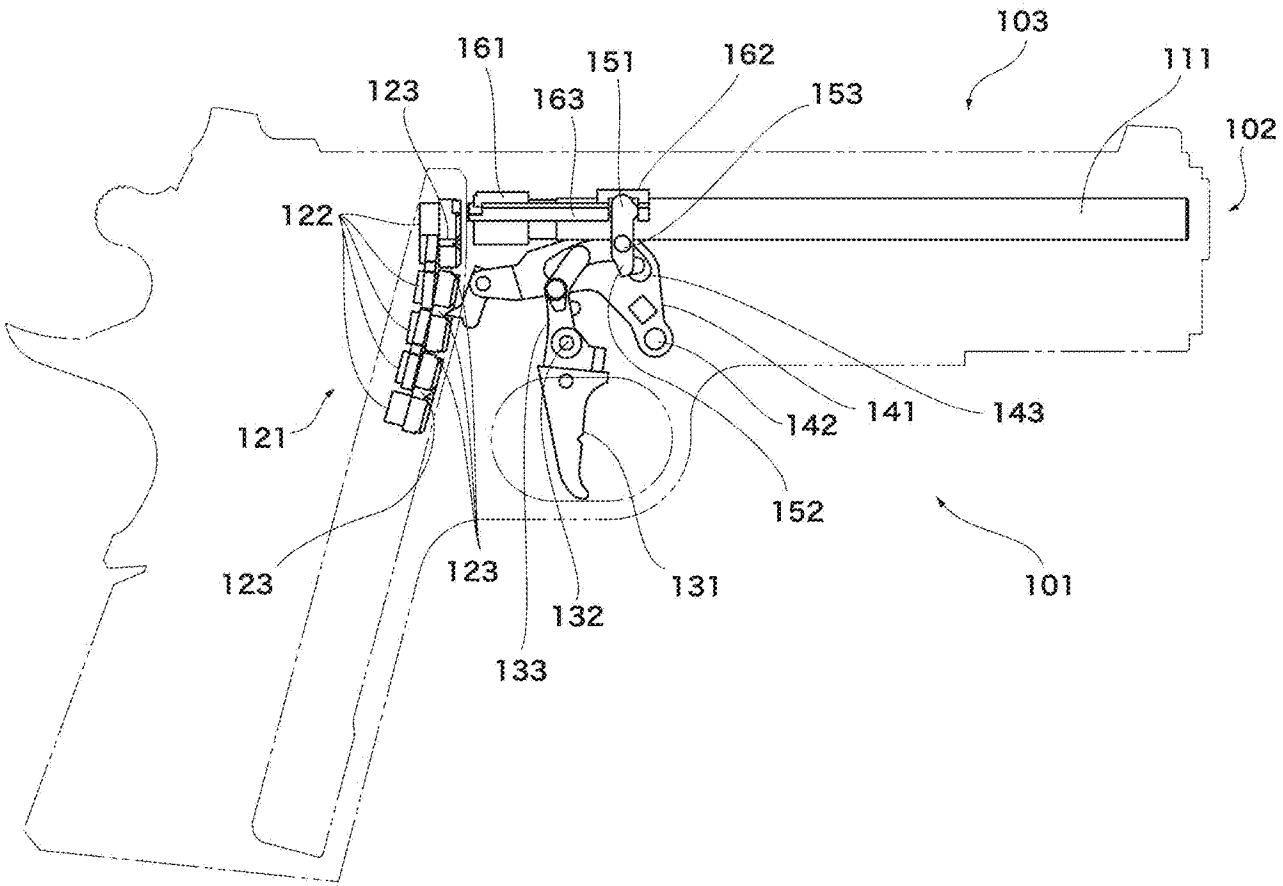
FIG. 4 is a rear sectional view of a toy gun in an example of an embodiment of the present invention at the moment at which a nail starts moving a loading portion.

As the terminal 134 is guided along the long hole of the guide 143, the nail arm 141 is further rotated around the nail arm rotating shaft 142 from the state shown in FIG. 3 and FIG. 4. The tip of the nail arm 141 on the cartridge 121 side is moved to the lower side in the drawings. Since the nail 144 is attached to the nail arm 141, the nail 144 is also moved to the lower side in the drawings.

The tip of the nail 144 is fit into a fitting portion 123 of the cartridge 121; therefore, as the nail 144 is moved to the lower side, the nail 144 starts moving the cartridge 121 downward.

Since the link 151 has not been in contact with the terminal 134 yet, the link 151 faces downward in the direction perpendicular to the inner barrel 111.

Since the link 151 has not been moved, the end of the cover 161 on the cartridge 121 side is at a distance from loading portions 122.

As illustrated in the front view in FIG. 7 and the rear view in FIG. 8, at the moment at which the nail 144 has completed moving loading portions 122, each part is positioned as described below:

The trigger 131 has been further pulled. For this reason, the terminal 134 is moved to a position beyond the apex of the chevron-shaped long hole in the guide 143 of the nail arm 141.

Figure 5:
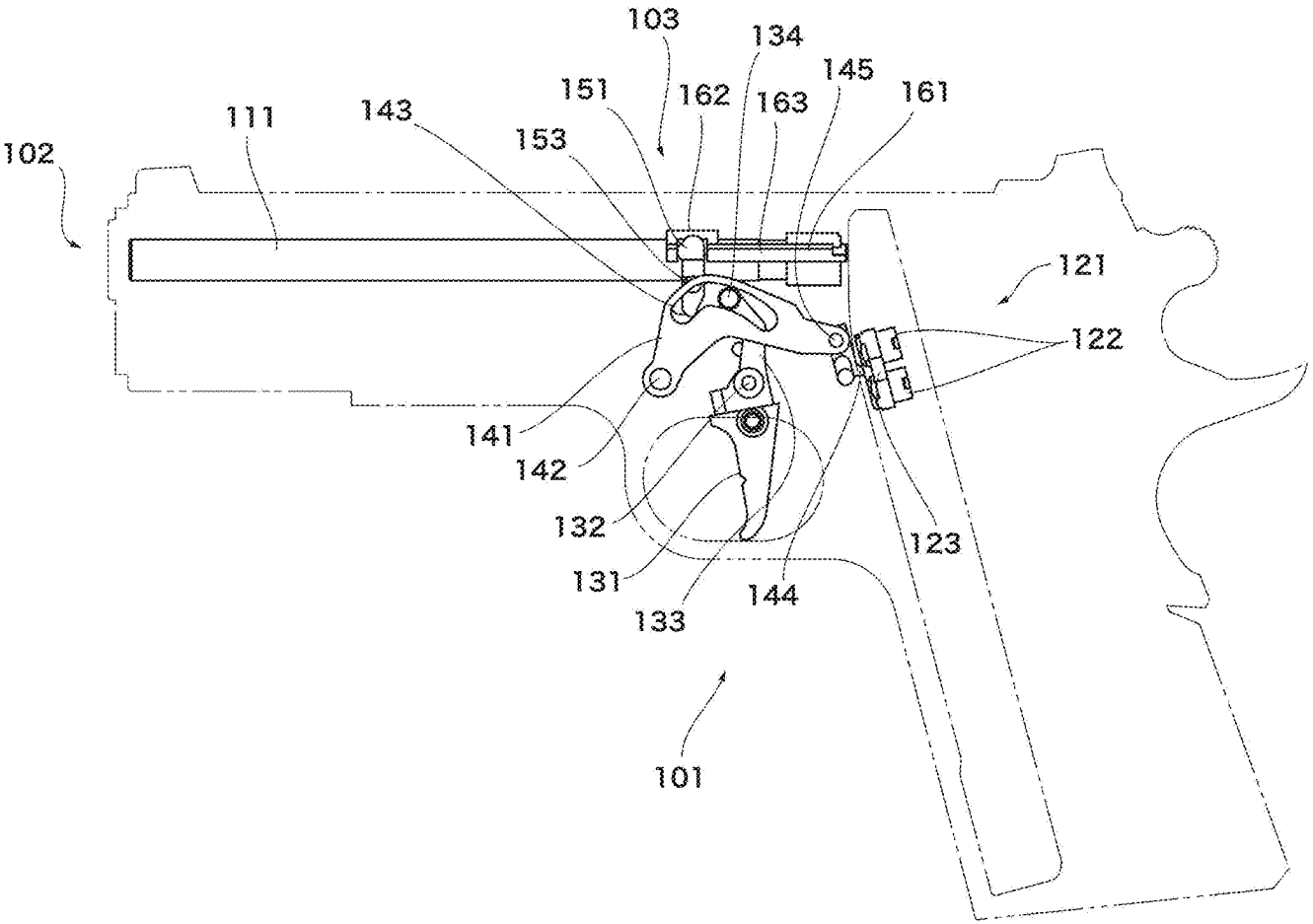
FIG. 5 is a front sectional view of a toy gun in an example of an embodiment of the present invention in the process of a nail moving a loading portion.
Figure 6:
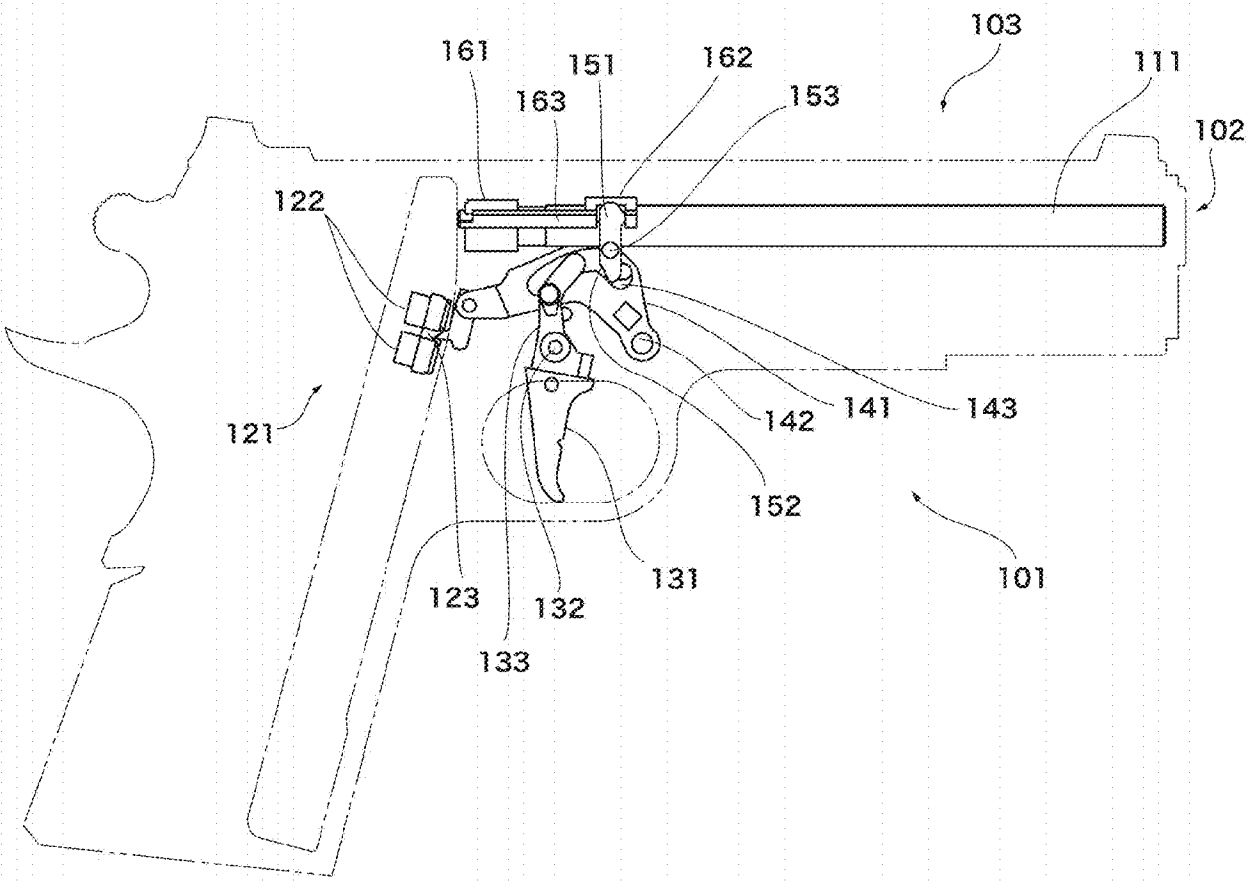
FIG. 6 is a rear sectional view of a toy gun in an example of an embodiment of the present invention in the process of a nail moving a loading portion.

As the terminal 134 is guided along the long hole of the guide 143, the nail arm 141 is further rotated around the nail arm rotating shaft 142 from the state shown in FIG. 5 and FIG. 6. The tip of the nail arm 141 on the cartridge 121 side is moved to the lower side in the drawings. Since the nail 144 is attached to the nail arm 141, the nail 144 is also moved to the lower side in the drawings.

The tip of the nail 144 is fit into a fitting portion 123 of the cartridge 121; therefore, as the nail 144 is moved to the lower side, the nail 144 further moves the cartridge 121 downward and the movement of the cartridge is eventually completed.

The terminal abutting portion 152 at the lower end of the link 151 starts contacting the terminal 134 and the free end as the lower end of the link 151 starts moving toward the muzzle 102. The upper end of the link 151 is fit into the link fitting portion 162 of the cover 161 attached to the inner barrel 111. The end of the cover 161 on the cartridge loading portion 122 side and both ends thereof on the muzzle 102 side are coupled together through the coupling portions 163. The end of the cover 161 on the cartridge 121 side is still at a distance from loading portions 122.

Figure 9:
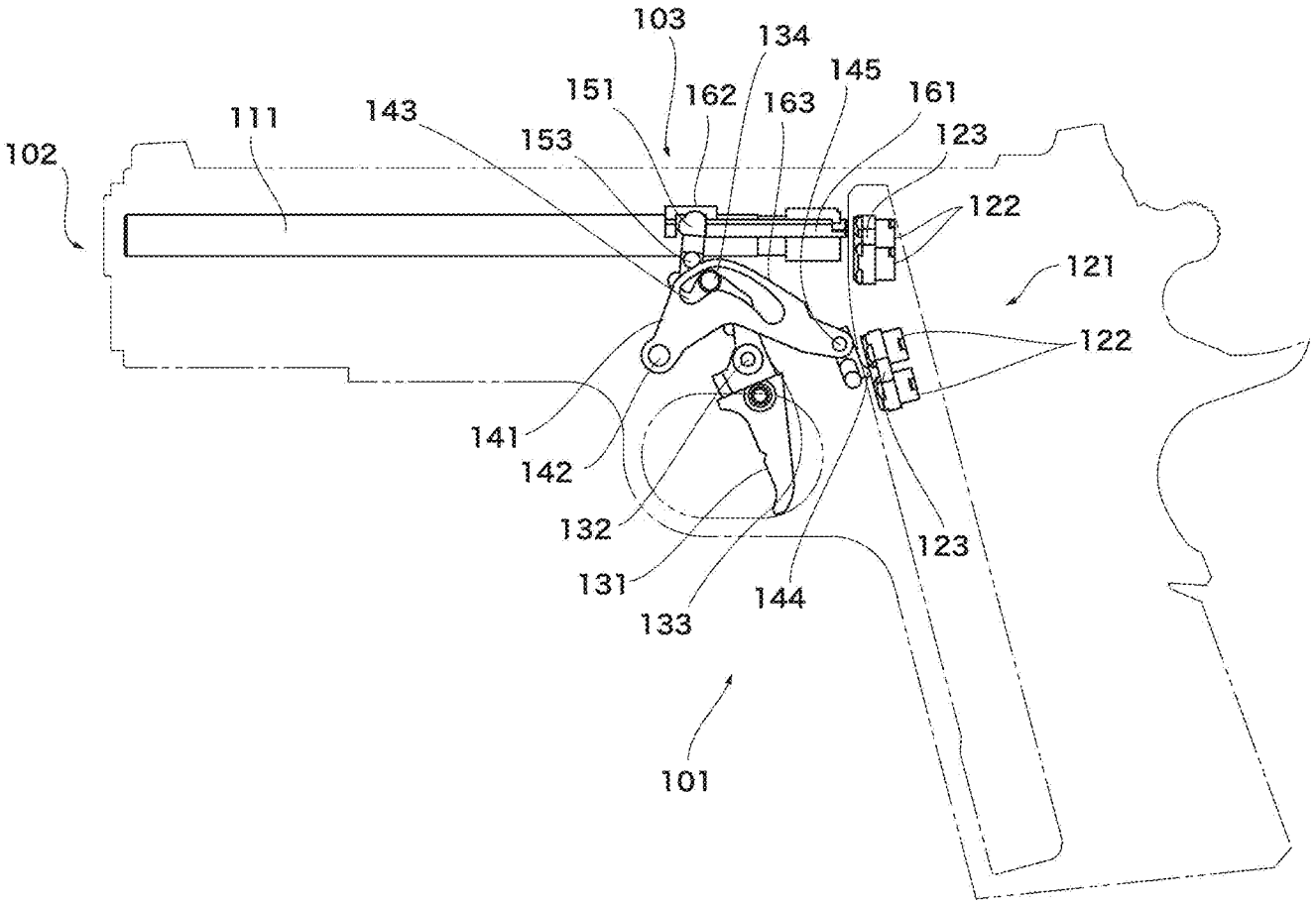
FIG. 9 is a front sectional view of a toy gun in an example of an embodiment of the present invention at the moment at which a link starts moving a cover.
Figure 10:
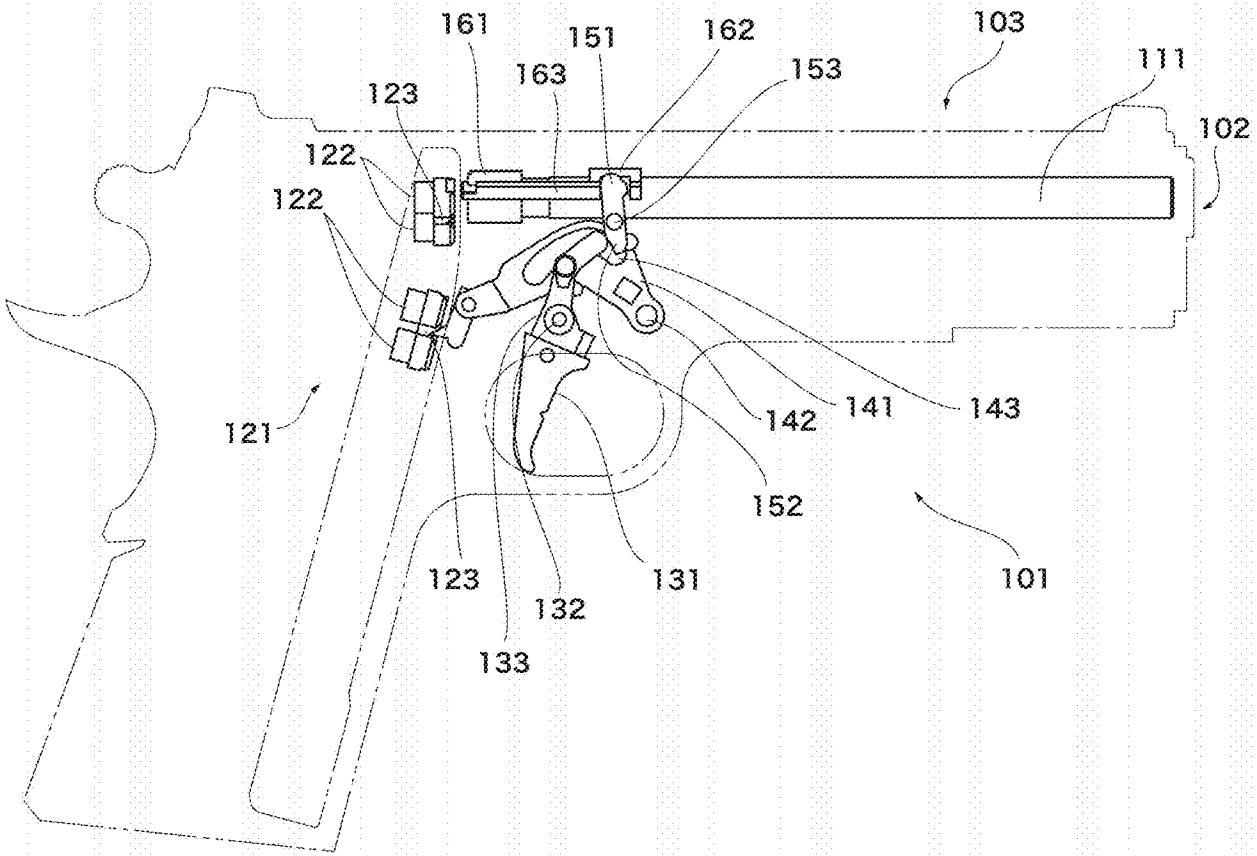
FIG. 10 is a rear sectional view of a toy gun in an example of an embodiment of the present invention at the moment at which a link starts moving a cover.

As illustrated in the front view in FIG. 9 and the rear view in FIG. 10, at the moment at which the link 151 starts moving the cover 161, each part is positioned as described below:

The trigger 131 has been further pulled. For this reason, the terminal 134 is moved to a position further beyond the apex of the chevron-shaped long hole in the guide 143 of the nail arm 141.

Figure 7:
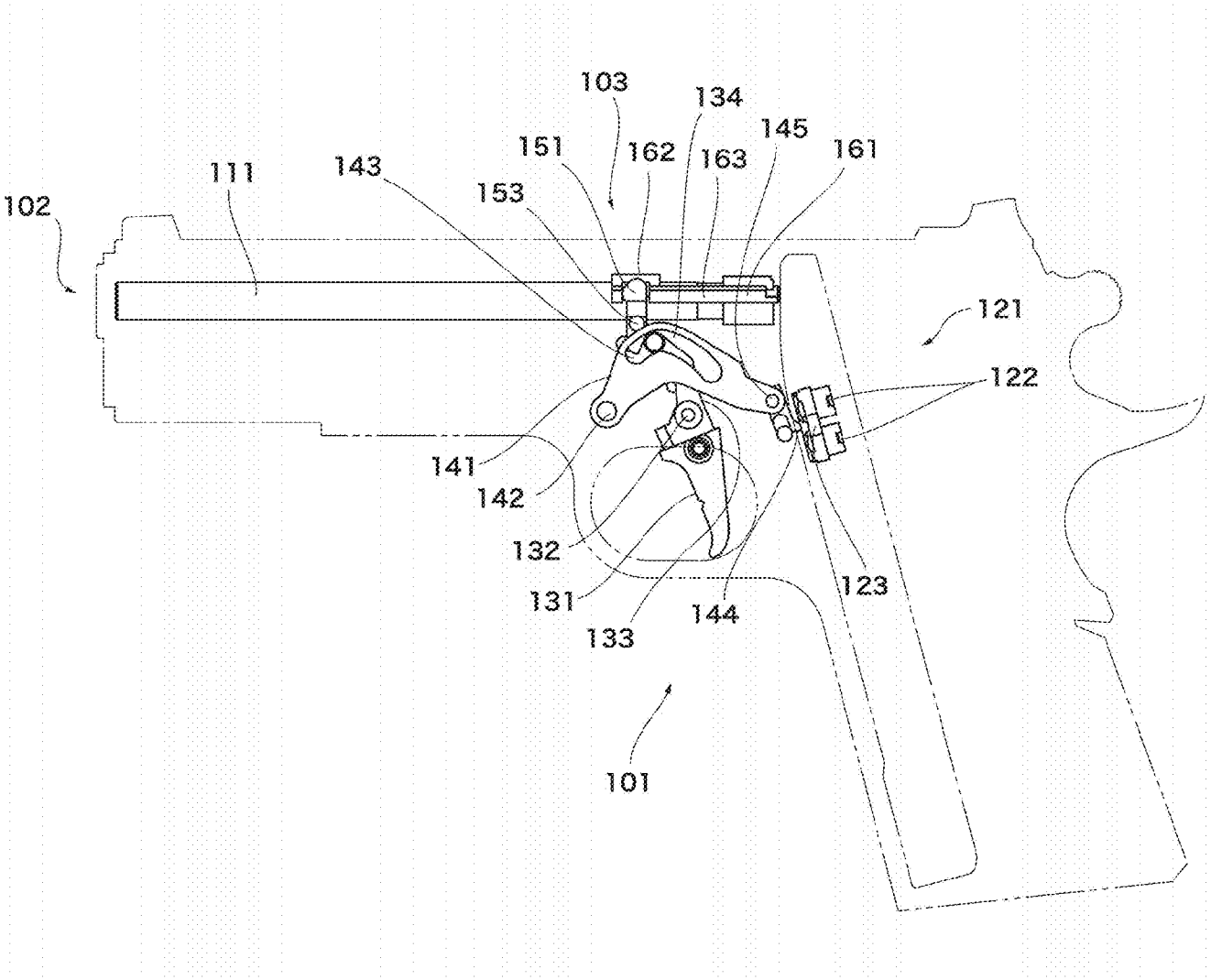
FIG. 7 is a front sectional view of a toy gun in an example of an embodiment of the present invention at the moment at which a nail has completed moving a loading portion.
Figure 8:
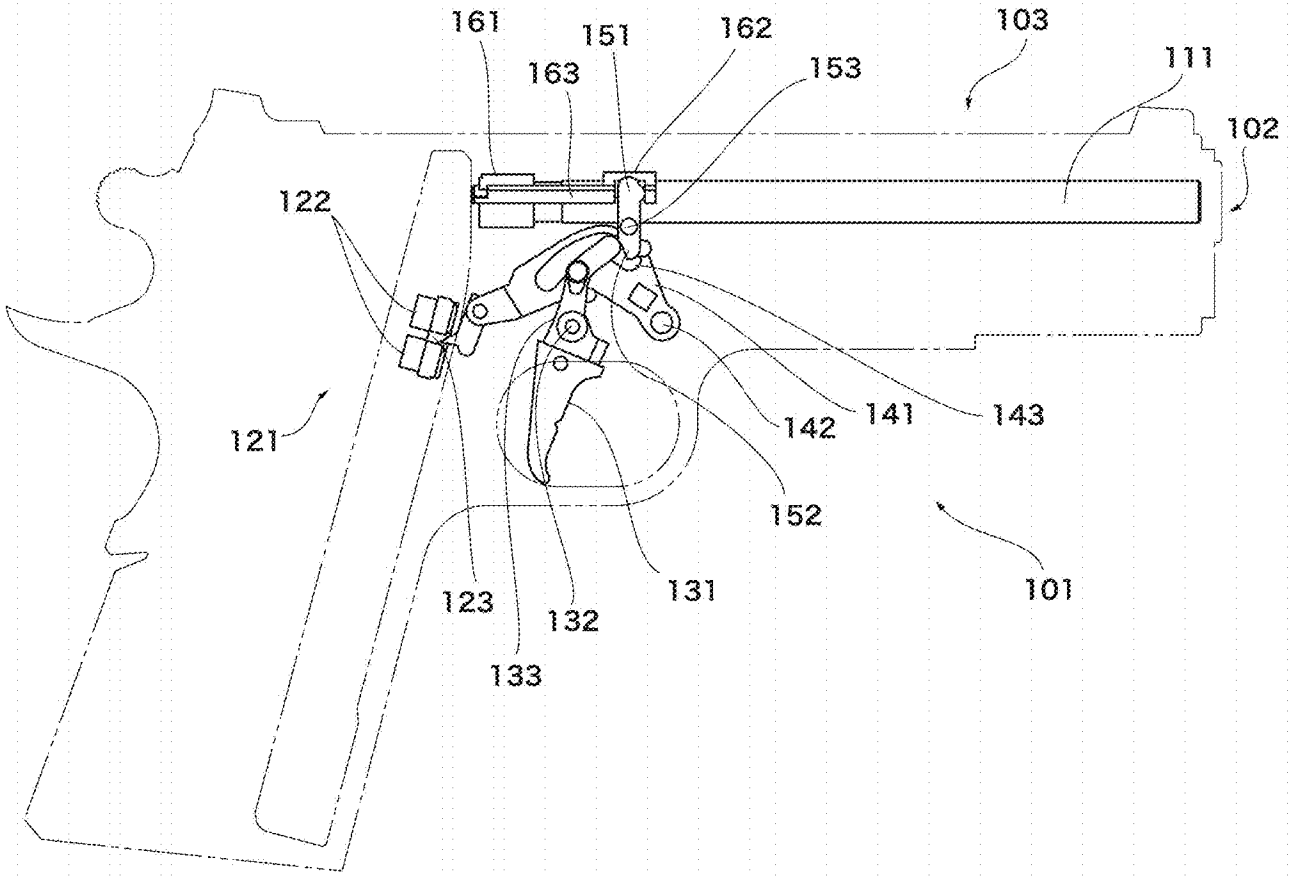
FIG. 8 is a rear sectional view of a toy gun in an example of an embodiment of the present invention at the moment at which a nail has completed moving a loading portion.

As the terminal 134 is guided along the long hole of the guide 143, the nail arm 141 is further rotated around the nail arm rotating shaft 142 from the state shown in FIG. 7 and FIG. 8. The movement to the lower side in the drawings of the tip of the nail arm 141 on the cartridge 121 side is completed. Since the nail 144 is attached to the nail arm 141, the movement to the lower side in the drawings of the nail 144 is also completed.

Since the tip of the nail 144 is fit into a fitting portion 123 of the cartridge 121, the further downward movement of the cartridge 121 in conjunction with the downward movement of the nail 144 is terminated.

The terminal abutting portion 152 at the lower end of the link 151 starts contacting the terminal 134 and the free end as the lower end of the link 151 starts moving toward the muzzle 102. The upper end of the link 151 is fit into the link fitting portion 162 of the cover 161 attached to the inner barrel 111. The end of the cover 161 on the cartridge loading portion 122 side and both ends thereof on the muzzle 102 side are coupled through the coupling portions 163. Therefore, the end of the cover 161 on the cartridge 121 side is about to start moving to the openings of loading portions 122.

Figure 11:
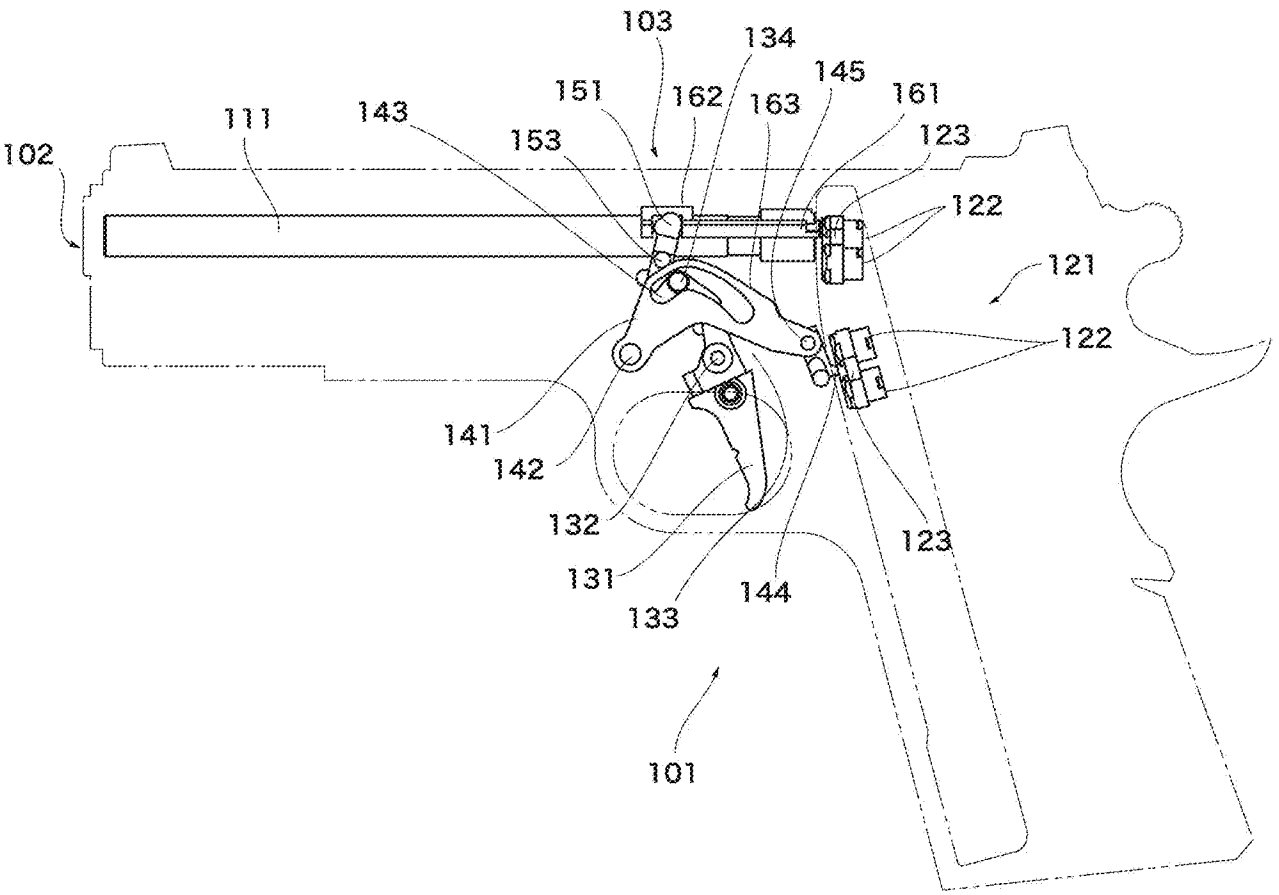
FIG. 11 is a front sectional view of a toy gun in an example of an embodiment of the present invention in the process of a link moving a cover.
Figure 12:
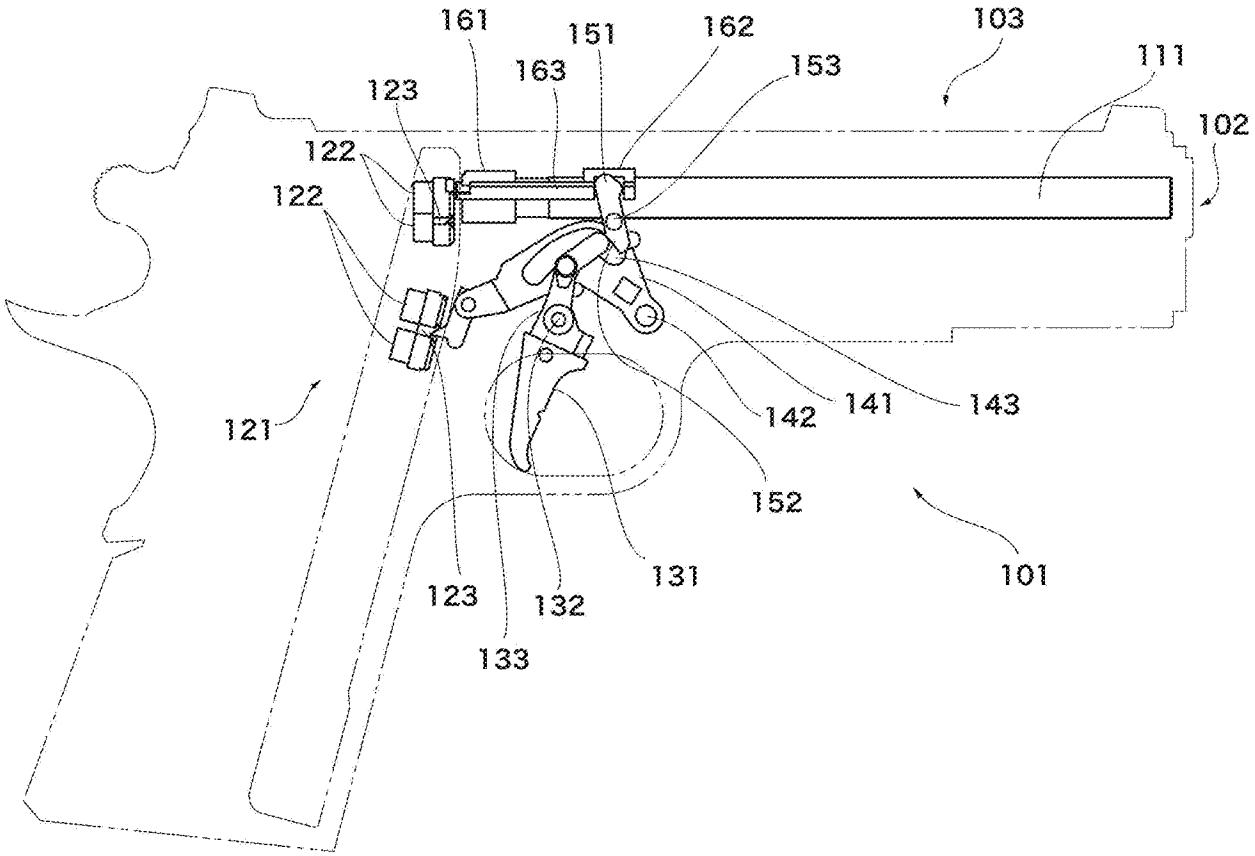
FIG. 12 is a rear sectional view of a toy gun in an example of an embodiment of the present invention in the process of a link moving a cover.

As illustrated in the front view in FIG. 11 and the rear view in FIG. 12, in the process of the link 151 moving the cover 161, each part is positioned as described below:

The trigger 131 has been further pulled. For this reason, the terminal 134 is moved to a position further beyond the apex of the chevron-shaped long hole in the guide 143 of the nail arm 141.

As the terminal 134 is guided along the long hole of the guide 143, the nail arm 141 is further rotated around the nail arm rotating shaft 142 from the state shown in FIG. 7 and FIG. 8. The movement to the lower side in the drawings of the tip of the nail arm on the cartridge 121 side has been completed. Since the nail 144 is attached to the nail arm 141, the movement to the lower side in the drawings of the nail 144 has also been completed.

Since the tip of the nail 144 is fit into a fitting portion 123 of the cartridge 121, the further downward movement of the cartridge 121 in conjunction with the downward movement of the nail 144 has also been completed.

The terminal abutting portion 152 at the lower end of the link 151 is brought into contact with the terminal 134 and the free end as the lower end of the link 151 is moved to the muzzle 102 side. The upper end of the link 151 is fit into the link fitting portion 162 of the cover 161 attached to the inner barrel 111. The end of the cover 161 on the cartridge loading portion 122 side and both ends thereof on the muzzle 102 side are coupled together through the coupling portions 163. Therefore, the end of the cover 161 on the cartridge 121 side is moved to the openings of loading portions 122.

Figure 13:
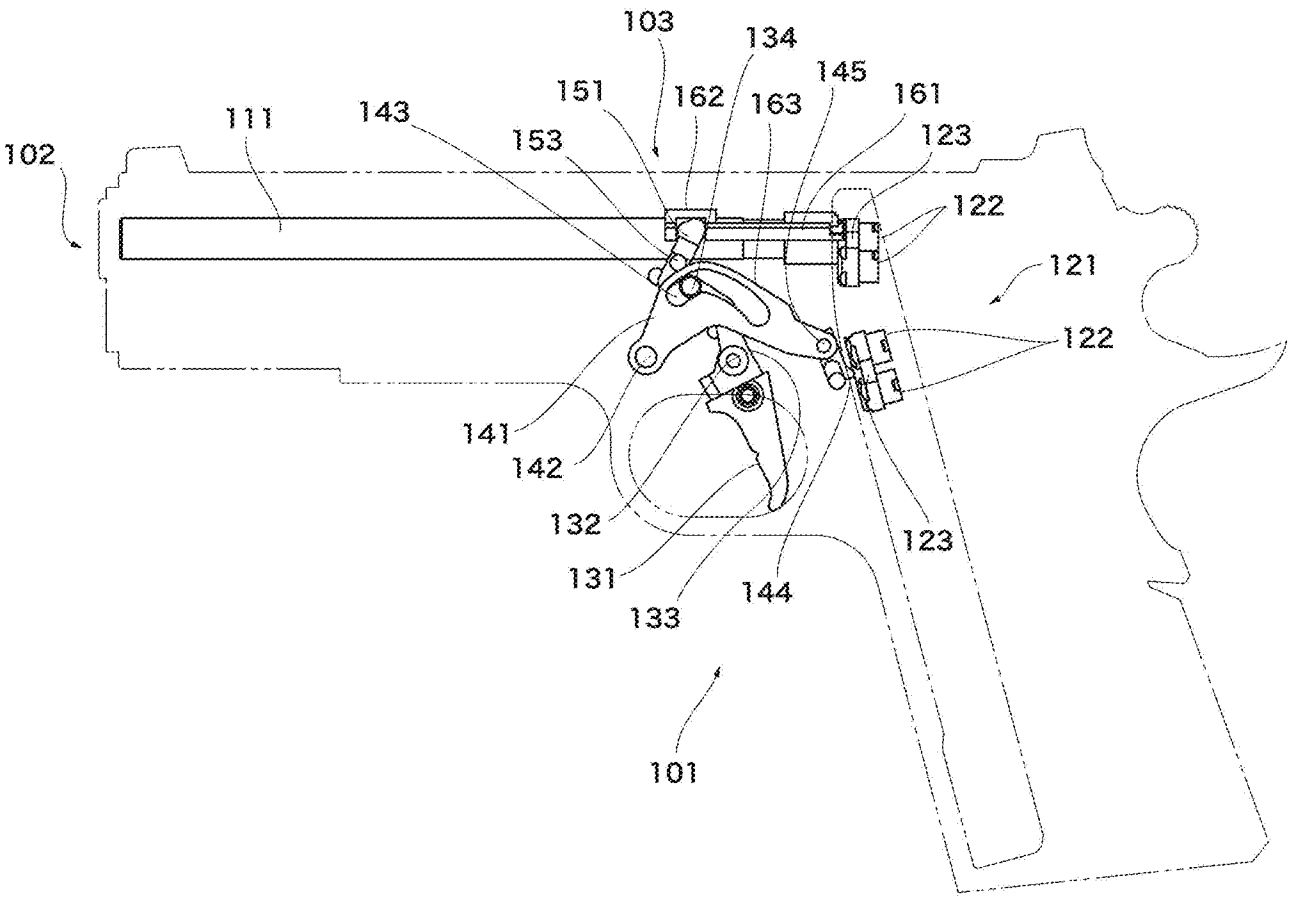
FIG. 13 is a front sectional view of a toy gun in an example of an embodiment of the present invention at the moment at which a link has completed moving a cover.
Figure 14:
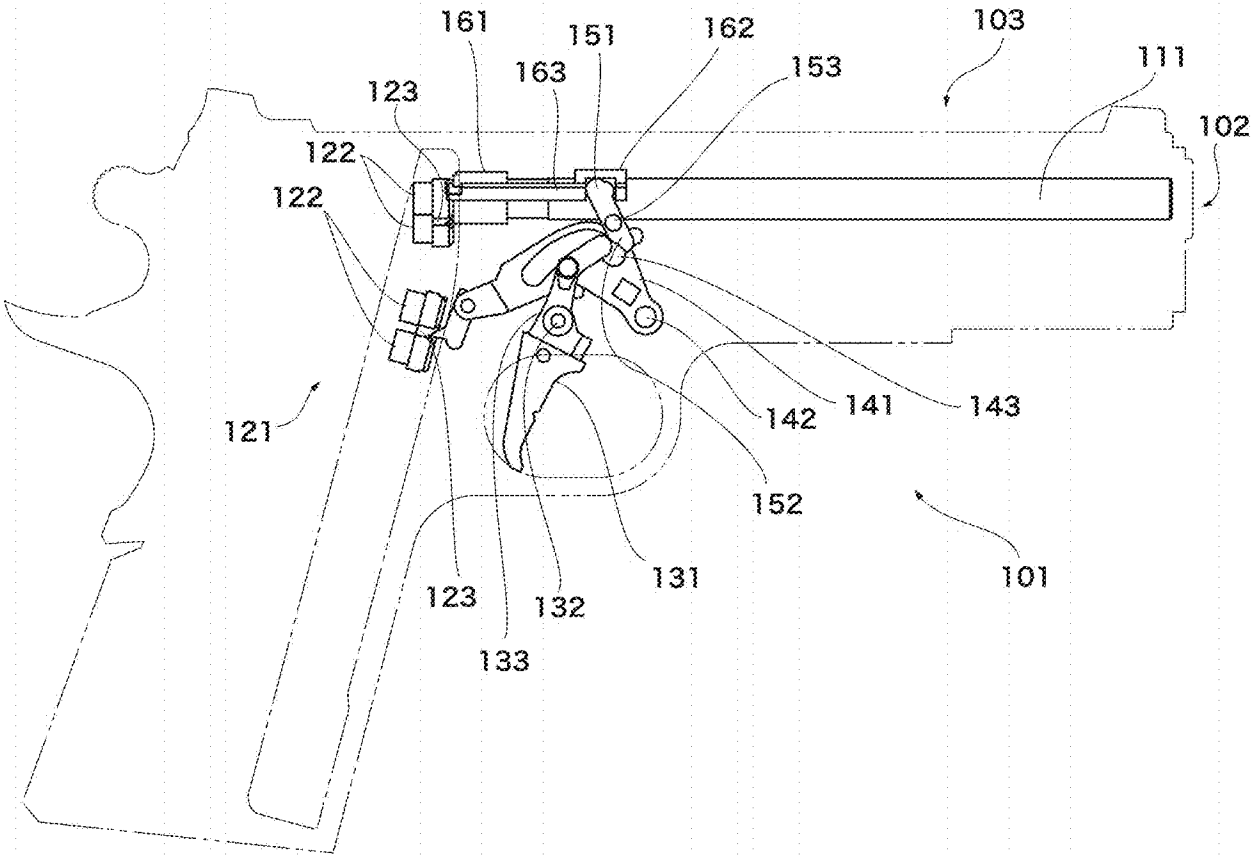
FIG. 14 is a rear sectional view of a toy gun in an example of an embodiment of the present invention at the moment at which a link has completed moving a cover.

As illustrated in the front view in FIG. 13 and the rear view in FIG. 14, at the moment at which the link 151 has completed moving the cover 161, each part is positioned as described below:

The trigger 131 has been further pulled. For this reason, the terminal 134 is moved to a position further beyond the apex of the chevron-shaped long hole in the guide 143 of the nail arm 141.

The terminal abutting portion 152 at the lower end of the link 151 is brought into contact with the terminal 134 and the free end as the lower end of the link 151 is moved to the muzzle 102 side. The upper end of the link 151 is fit into the link fitting portion 162 of the cover 161 attached to the inner barrel 111. The end of the cover 161 on the cartridge loading portion 122 side and both ends thereof on the muzzle 102 side are coupled together through the coupling portions 163. Therefore, the end of the cover 161 on the cartridge 121 side is moved to and closes the openings of loading portions 122.

Figure 15:
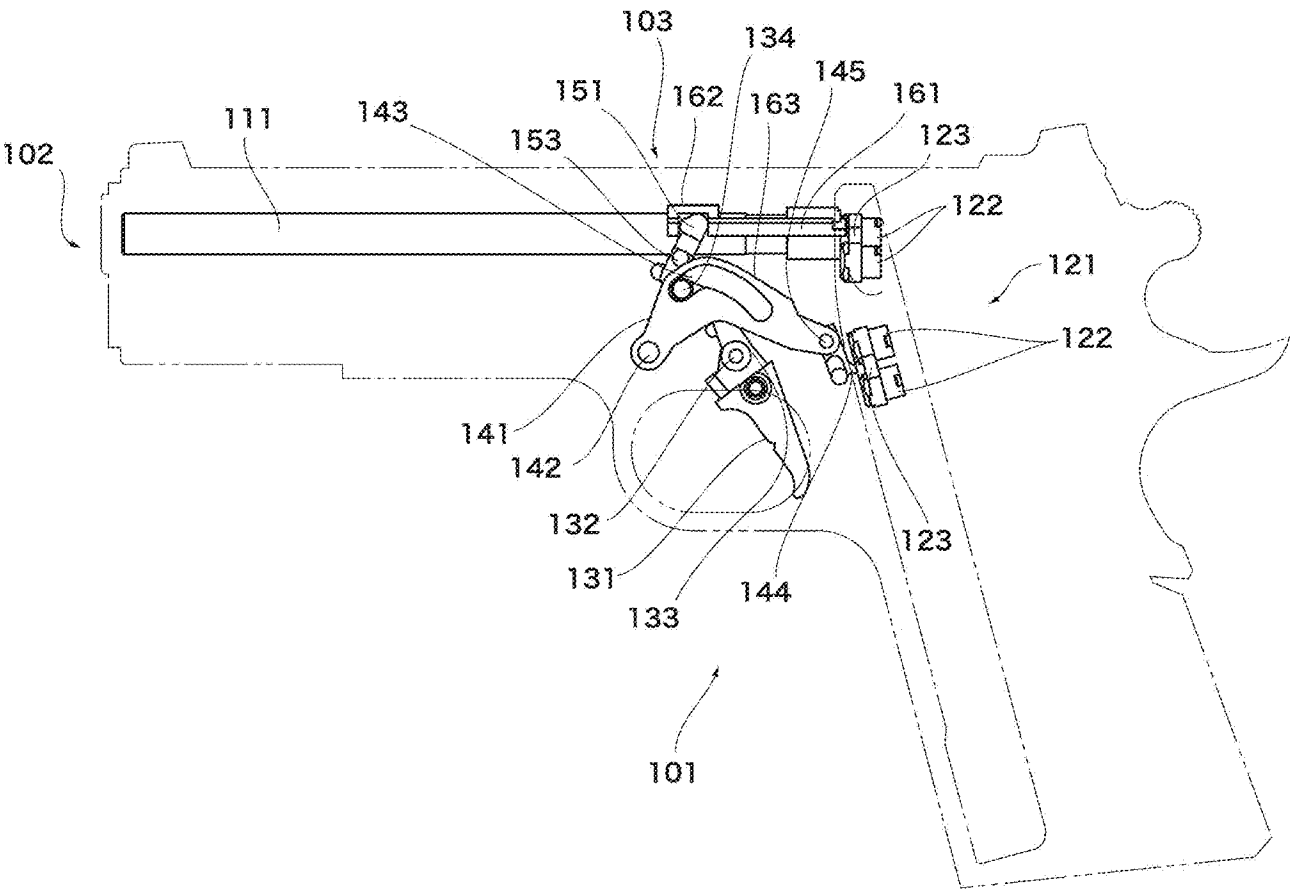
FIG. 15 is a front sectional view of a toy gun in an example of an embodiment of the present invention as a trigger is fully pulled.
Figure 16:
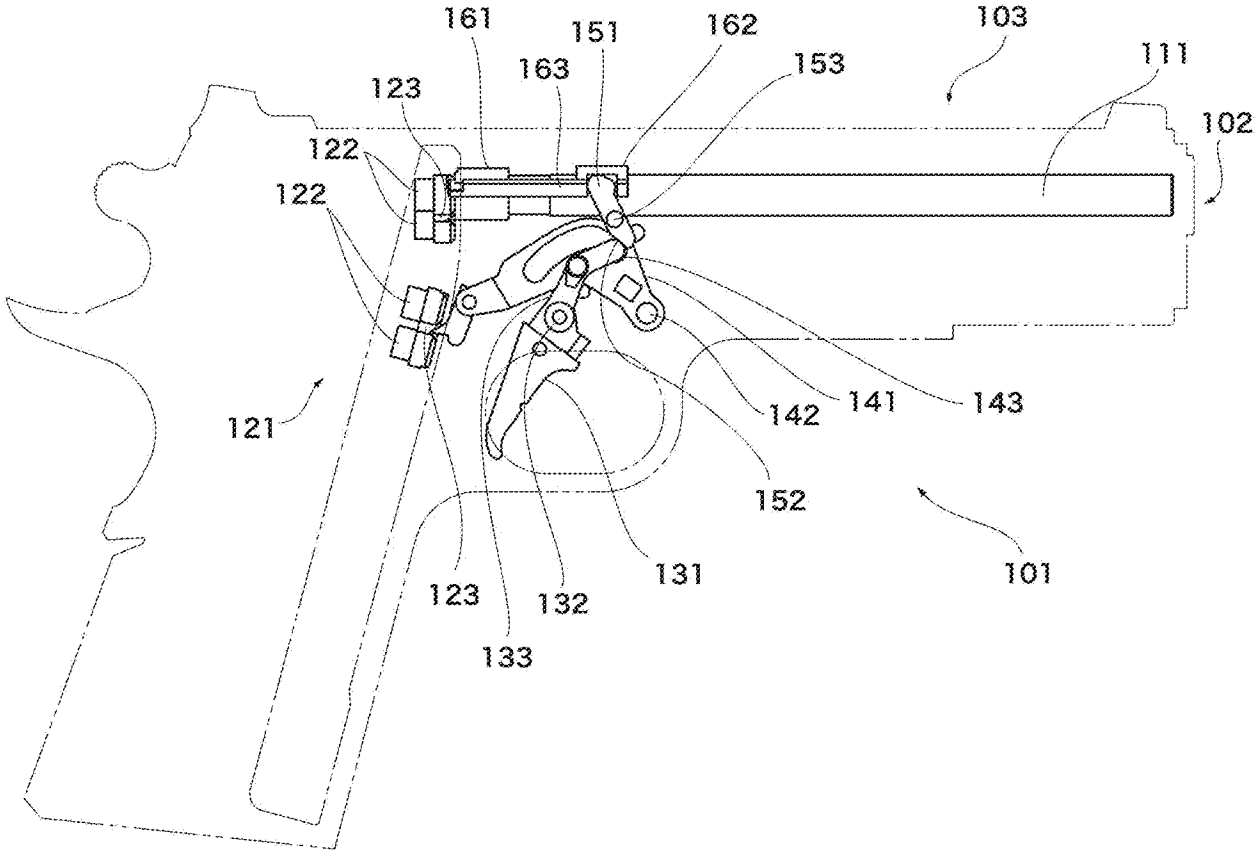
FIG. 16 is a rear sectional view of a toy gun in an example of an embodiment of the present invention as a trigger is fully pulled.

As illustrated in the front view in FIG. 15 and the rear view in FIG. 16, with the trigger 131 fully pulled, each part is positioned as described below:

The trigger 131 has been further pulled. For this reason, the terminal 134 is moved to a position on the muzzle 102 side in the chevron-shaped long hole in the guide 143 of the nail arm 141.

The terminal abutting portion 152 at the lower end of the link 151 is brought into contact with the terminal 134 and the free end as the lower end of the link 151 is moved to the muzzle 102 side. The upper end of the link 151 is fit into the link fitting portion 162 of the cover 161 attached to the inner barrel 111. The end of the cover 161 on the cartridge loading portion 122 side and both ends thereof on the muzzle 102 side are coupled together through the coupling portions 163. Therefore, the end of the cover 161 on the cartridge 121 side is moved to and completely closes the openings of loading portions 122.

This embodiment makes it possible to make the operating range of the cartridge 121 in a magazine longer than in a conventional technique.

In the conventional technique, there is a gap between the cartridge 121 and the inner barrel 111. In the present invention, meanwhile, the cover 161 which is operated in conjunction with the rotation of the cartridge 121 and closes the above gap is provided between the cartridge 121 and the inner barrel 111. This prevents compressed gas as an energy source from leaking from the above gap for the enhancement of energy efficiency.

What is claimed is:

1. A toy gun comprising:

an inner barrel through which a bullet passes when the bullet is fired;

a cartridge placed at a base of the inner barrel and continuously provided with cartridge loading portions loaded with bullets;

a trigger placed below the inner barrel and operated to fire a bullet;

a trigger rotating shaft around which the trigger rotates;

a terminal provided closer to the inner barrel than to the trigger rotating shaft on an extension line of the trigger;

a nail arm rotating shaft placed on a side opposite to the cartridge with the trigger rotating shaft in between the nail arm rotating shaft and the cartridge;

a nail arm rotated around the nail arm rotating shaft;

a guide as a long hole provided in the nail arm in a direction along the inner barrel as a whole and guiding the terminal;

a nail which is attached to an end of the nail arm and the nail is configured to engage with a cartridge loading portion;

a cover which is provided at the end of the inner barrel on a side of the cartridge the cover is configured to be abutted against the cartridge loading portion, and the cover is configured to slide from the side of the cartridge toward the side opposite to the cartridge; and a link which slides the cover to the cartridge side and the side opposite to the cartridge by bringing the terminal into and out of abutment.

2. The toy gun according to claim 1, wherein the link is attached to the cover.

3. The toy gun according to claim 1, wherein the nail arm is substantially in an L shape.

4. The toy gun according to claim 2, wherein the nail arm is substantially in an L shape.

* * * * *